US011067098B2

(12) United States Patent
Sishtla

(10) Patent No.: US 11,067,098 B2
(45) Date of Patent: Jul. 20, 2021

(54) SILENCER FOR A CENTRIFUGAL COMPRESSOR ASSEMBLY

(71) Applicant: Carrier Corporation, Palm Beach Gardens, FL (US)

(72) Inventor: Vishnu M. Sishtla, Manlius, NY (US)

(73) Assignee: CARRIER CORPORATION, Palm Beach Gardens, FL (US)

( * ) Notice: Subject to any disclaimer, the term of this patent is extended or adjusted under 35 U.S.C. 154(b) by 3 days.

(21) Appl. No.: 16/246,979

(22) Filed: Jan. 14, 2019

(65) Prior Publication Data

US 2019/0242408 A1 Aug. 8, 2019

Related U.S. Application Data

(60) Provisional application No. 62/625,677, filed on Feb. 2, 2018.

(51) Int. Cl.

| | |
|---|---|
| ***F04D 29/66*** | (2006.01) |
| ***F04D 29/44*** | (2006.01) |
| ***F04D 17/12*** | (2006.01) |
| ***F04D 17/10*** | (2006.01) |

(52) U.S. Cl.
CPC ..... *F04D 29/664* (2013.01); *F04D 17/10* (2013.01); *F04D 17/12* (2013.01); *F04D 29/441* (2013.01)

(58) Field of Classification Search
CPC .... F04D 29/664; F04D 29/441; F04D 29/442; F04D 29/444; F04D 17/12
See application file for complete search history.

(56) References Cited

U.S. PATENT DOCUMENTS

| | | | | |
|---|---|---|---|---|
| 2,925,952 | A * | 2/1960 | Garve | F04D 29/444 415/208.3 |
| 4,504,188 | A * | 3/1985 | Traver | F04D 29/441 415/1 |
| 4,692,091 | A | 9/1987 | Ritenour | |
| 5,249,919 | A | 10/1993 | Sishtla et al. | |
| 5,520,507 | A | 5/1996 | Haugen | |
| 6,540,480 | B2 | 4/2003 | Nikpour | |
| 6,547,520 | B2 | 4/2003 | Zinsmeyer et al. | |
| 6,550,574 | B2 | 4/2003 | Liu | |
| 6,669,436 | B2 | 12/2003 | Liu | |

(Continued)

FOREIGN PATENT DOCUMENTS

| | | | |
|---|---|---|---|
| CN | 103939397 | A | 7/2014 |
| EP | 1602810 | A1 | 12/2005 |

(Continued)

OTHER PUBLICATIONS

Extended European Search Report; International Application No. 191550599-1007; International Filing Date: Feb. 1, 2019; dated Jun. 14, 2019; 8 pages.

(Continued)

*Primary Examiner* — Richard A Edgar
*Assistant Examiner* — Jackson N Gillenwaters
(74) *Attorney, Agent, or Firm* — Cantor Colburn LLP

(57) ABSTRACT

A compressor includes a diffuser section having a diffuser structure and a silencer. The silencer includes a silencer housing defining a cavity and a silencing pad disposed within the cavity, wherein an exposed surface of the silencing pad is arranged in contact with a portion of the diffuser structure.

17 Claims, 7 Drawing Sheets

(56) References Cited

U.S. PATENT DOCUMENTS

| | | | | |
|---|---|---|---|---|
| 6,814,540 | B2 * | 11/2004 | Sishtla | F04D 27/0246 415/148 |
| 6,896,095 | B2 | 5/2005 | Shah et al. | |
| 7,001,140 | B2 | 2/2006 | Hustvedt et al. | |
| 7,014,421 | B2 | 3/2006 | French | |
| 7,399,156 | B2 | 7/2008 | Sterner et al. | |
| 7,431,560 | B2 | 10/2008 | Sterner | |
| 7,722,316 | B2 * | 5/2010 | Scarinci | F04D 29/663 415/119 |
| 8,632,302 | B2 * | 1/2014 | Sorokes | F04D 29/444 415/161 |
| 8,834,097 | B2 * | 9/2014 | Jewess | F01D 9/045 415/119 |
| 9,086,002 | B2 | 7/2015 | Konig | |
| 9,255,586 | B2 * | 2/2016 | Lee | F04D 29/444 |
| 9,618,001 | B2 * | 4/2017 | Isogai | F02C 6/12 |
| 10,072,663 | B2 * | 9/2018 | Sun | F04D 29/464 |
| 2004/0088986 | A1 * | 5/2004 | Brasz | F04D 29/444 60/671 |
| 2010/0034634 | A1 | 2/2010 | Scarinci et al. | |
| 2017/0089360 | A1 | 3/2017 | Yang et al. | |
| 2019/0178262 | A1 * | 6/2019 | Bussow | F04D 29/406 |

FOREIGN PATENT DOCUMENTS

| | | | |
|---|---|---|---|
| EP | 2613056 | A1 | 7/2013 |
| JP | 2015197053 | A | 11/2015 |
| JP | 2017180283 | A | 10/2017 |
| WO | 2013112122 | A2 | 8/2013 |
| WO | 2017136173 | A1 | 8/2017 |

OTHER PUBLICATIONS

Indian Office Action; International Application No. 201914003941; International Filing Date: Jan. 31, 2019; dated Feb. 13, 2020; 7 pages.

* cited by examiner

SILENCER FOR A CENTRIFUGAL COMPRESSOR ASSEMBLY

CROSS-REFERENCE TO RELATED APPLICATIONS

This application claims the benefit of U.S. Provisional Application Ser. No. 62/625,677, filed Feb. 2, 2018, which is incorporated herein by reference in its entirety.

BACKGROUND

Exemplary embodiments disclosed herein relate generally to a refrigeration system, and more particularly, to an improvement for reducing the noise generated by a centrifugal compressor of a refrigeration system.

A refrigeration system having a centrifugal compressor is widely applied to different industrial occasions, to implement gas compression or pressurization. Noise associated with operation of the compressor may be a nuisance. One of the primary sources where noise is generated in the centrifugal compressor is the diffuser. Because fluid generally passes through the diffuser at an extremely high flow velocity and gradually slows down in the channel to convert kinetic energy into pressure energy, the pressure of the fluid at this position is further improved, thus resulting in an increase in the noise level at this position. In such a case, the excessively high noise may be severely harmful to the persons nearby, and the continuous high noise may further lead to violent vibration of the machine structure, resulting in a failure of the machine.

BRIEF DESCRIPTION

Disclosed is a compressor includes a diffuser section having a diffuser structure and a silencer. The silencer includes a silencer housing defining a cavity and a silencing pad disposed within the cavity, wherein an exposed surface of the silencing pad is arranged in contact with a portion of the diffuser structure.

In addition to one or more of the features described above, or as an alternative, in further embodiments the diffuser structure includes a plurality of vanes, the plurality of vanes being arranged in contact with the exposed surface of the silencing pad.

In addition to one or more of the features described above, or as an alternative, in further embodiments the diffuser structure is fixed.

In addition to one or more of the features described above, or as an alternative, in further embodiments the diffuser structure is rotatable about an axis.

In addition to one or more of the features described above, or as an alternative, in further embodiments the diffuser structure is mounted to a first surface of the compressor.

In addition to one or more of the features described above, or as an alternative, in further embodiments the diffuser structure is integrally formed with a first surface of the compressor.

In addition to one or more of the features described above, or as an alternative, in further embodiments the silencer is affixed to a surface of the compressor facing the diffuser section.

In addition to one or more of the features described above, or as an alternative, in further embodiments the silencer is arranged within a circumferential groove formed in a surface of the compressor facing the diffuser section.

In addition to one or more of the features described above, or as an alternative, in further embodiments the exposed surface of the silencing pad is partially compressed by the contact with the portion of the diffuser structure.

In addition to one or more of the features described above, or as an alternative, in further embodiments silencing pad is formed from a flexible material.

In addition to one or more of the features described above, or as an alternative, in further embodiments the silencing pad includes a sound absorbing material.

In addition to one or more of the features described above, or as an alternative, in further embodiments the silencing pad includes a plurality of sound absorbing material layers.

In addition to one or more of the features described above, or as an alternative, in further embodiments the silencing pad further includes a body formed from a sound absorbing material and a jacket encasing the body.

In addition to one or more of the features described above, or as an alternative, in further embodiments the jacket includes at least one of glass, polymer, and metallic mesh or fabric.

In addition to one or more of the features described above, or as an alternative, in further embodiments the compressor is a centrifugal compressor.

In addition to one or more of the features described above, or as an alternative, in further embodiments the diffuser section is arranged at a first stage of the compressor.

In addition to one or more of the features described above, or as an alternative, in further embodiments the diffuser section is arranged at a second stage of the compressor.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
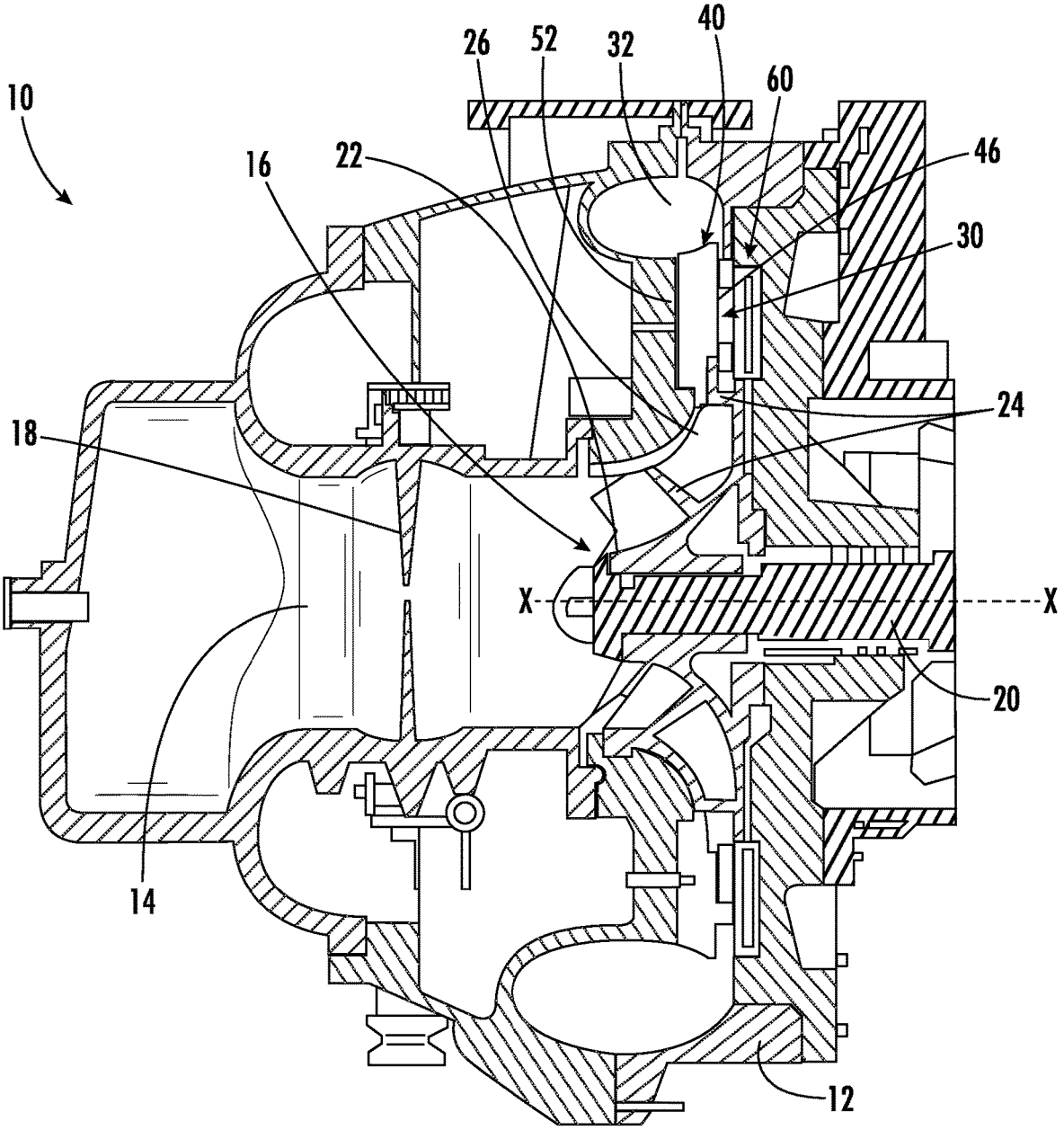
FIG. 1 is a cross-sectional view of a portion of a centrifugal compressor according to an embodiment.

Referring now to FIG. 1, an example of a centrifugal compressor 10 is illustrated. As shown, the centrifugal compressor 10 includes a main casing 12 having an inlet 14 that directs refrigerant into a rotating impeller 16 through a series of adjustable inlet guide vanes 18. The impeller 16 is secured to a drive shaft 20 by any suitable means to align impeller 16 along the axis of the compressor 10. The impeller 16 includes central hub 22 supporting a plurality of blades 24. A plurality of passages 26 defined between adjacent blades 24 cause the incoming axial flow of a refrigerant fluid to turn in a radial direction and discharge the compressed refrigerant fluid from respective passages 26 into an adjacent diffuser section 30. The diffuser section 30 is generally circumferentially disposed about the impeller 16 and functions to direct the compressed refrigerant fluid into a toroidal-shaped volute 32, which directs the compressed fluid toward a compressor outlet, or alternatively, toward a second stage of the compressor 10, depending on the configuration of the compressor.

Figure 2:
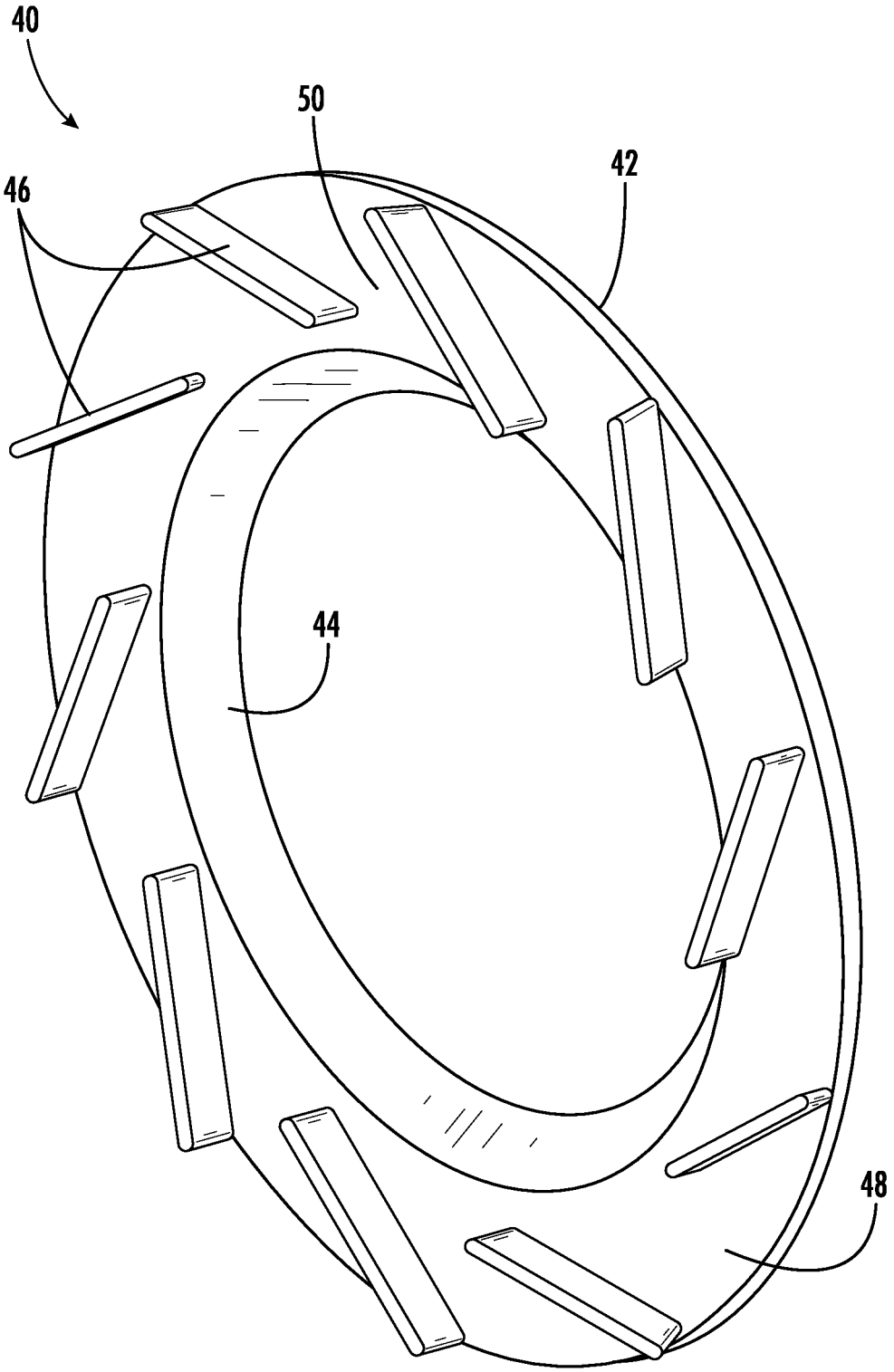
FIG. 2 is a perspective view of a vaned diffuser structure according to an embodiment.

The diffuser section 30 includes a disc-like diffuser structure 40 having an outer circular edge 42 and a circular inner edge 44. When the diffuser structure 40 is mounted within the compressor 10, the outer circular edge 42 closely surrounds the impeller 16, such that refrigerant may be discharged from the impeller 16 to the diffuser 40. In the illustrated, non-limiting embodiment, best shown in FIG. 2, the diffuser structure 40 includes a plurality of circumferentially spaced, fixed vanes 46, extending from a first, generally planar surface 48 thereof. The plurality of vanes 46 may be substantially identical, or alternatively, may vary in size, shape, and/or orientation relative to a central axis X of the compressor 10. As the refrigerant passes through the passageways 50 defined between adjacent vanes 46 of the diffuser structure 40, the kinetic energy of the refrigerant may be converted to a potential energy or static pressure. Further, it should be understood that the diffuser structure 40 illustrated and described herein is intended as an example only and that other types of diffuser structures 40, such as a pipe diffuser or a channel type diffuser having one or more passages formed within the disc-like diffuser structure and arranged in fluid communication with the passages 26 of the impeller 16 are also contemplated herein.

Figure 3:
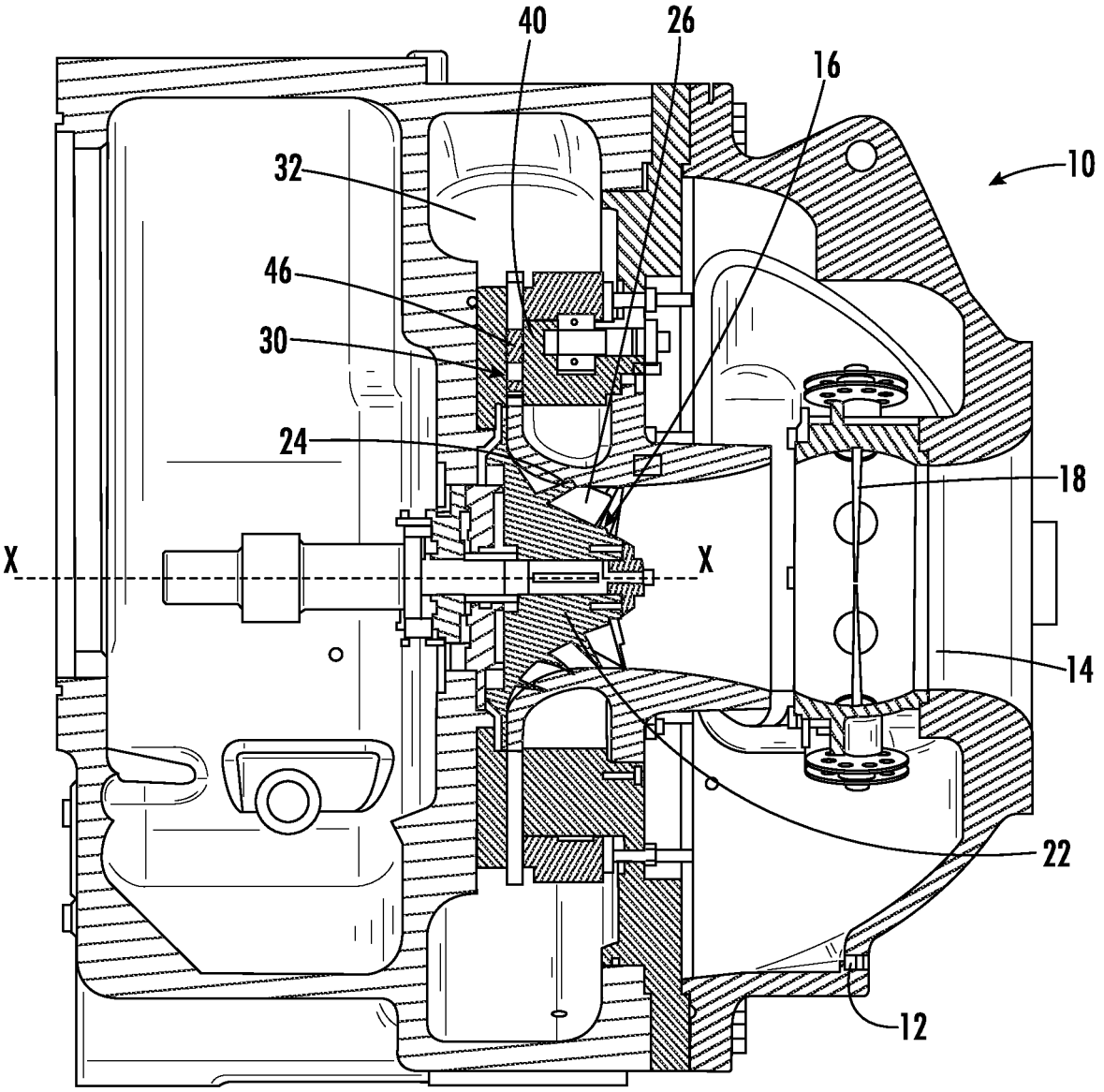
FIG. 3 is a cross-sectional view of a portion of a centrifugal compressor according to another embodiment.
Figure 4:
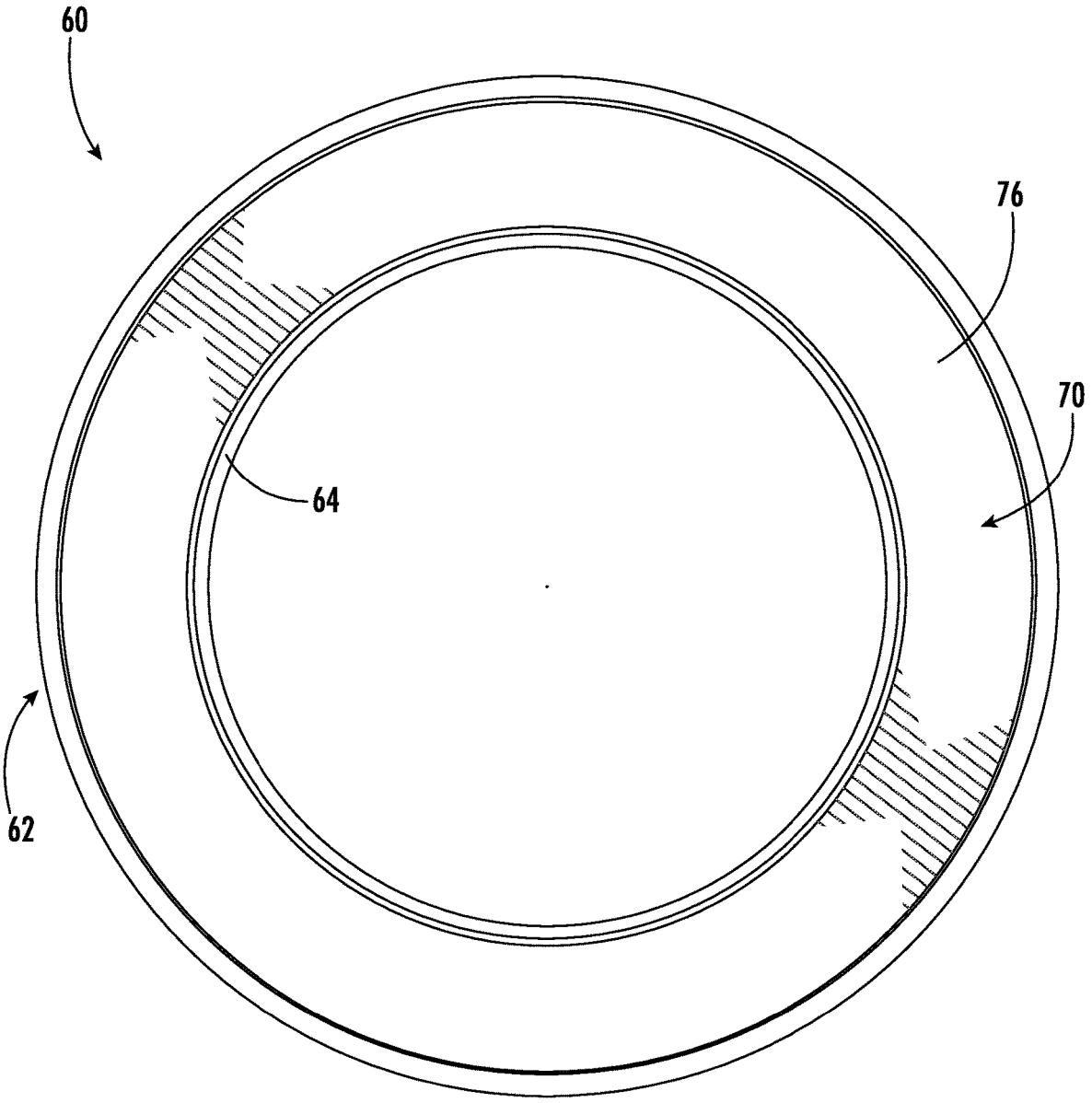
FIG. 4 is a front view of a silencer according to an embodiment.

As shown in FIG. 1, the diffuser structure 40 is rotationally fixed, and may be mounted against an interior wall 52 of the compressor housing, such as with one or more fasteners i.e. bolts or screws (not shown) for example. Alternatively, the fixed diffuser structure 40 may be integrally formed with the compressor housing, such as by machining the one or more vanes 46 or passages 48 of the diffuser structure 40 into the surface of the compressor housing located radially outward from the central axis and the impeller 16. With reference to FIG. 3, in other embodiments, the diffuser structure 40 may be configured to rotate about the axis X. In such embodiments, conventional mechanisms for rotatably mounting the diffuser structure 40 within the compressor 10 are contemplated herein.

Figure 5B:
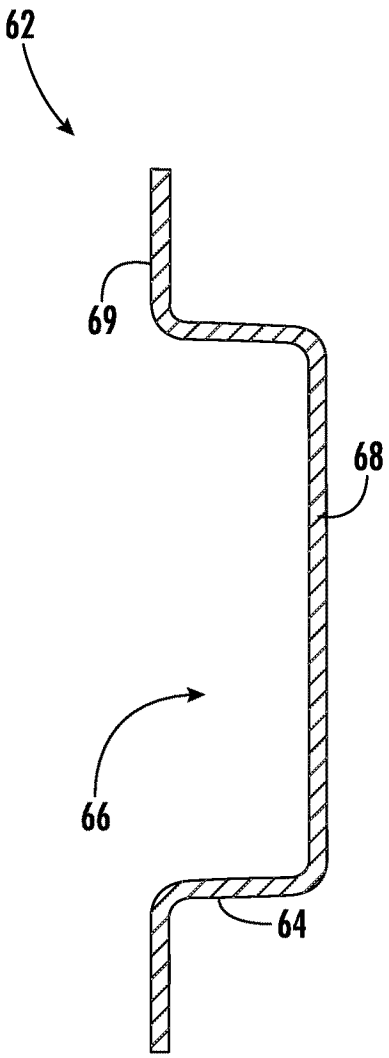
FIG. 5B is a cross-sectional view of a silencer housing according to an embodiment.
Figure 5A:
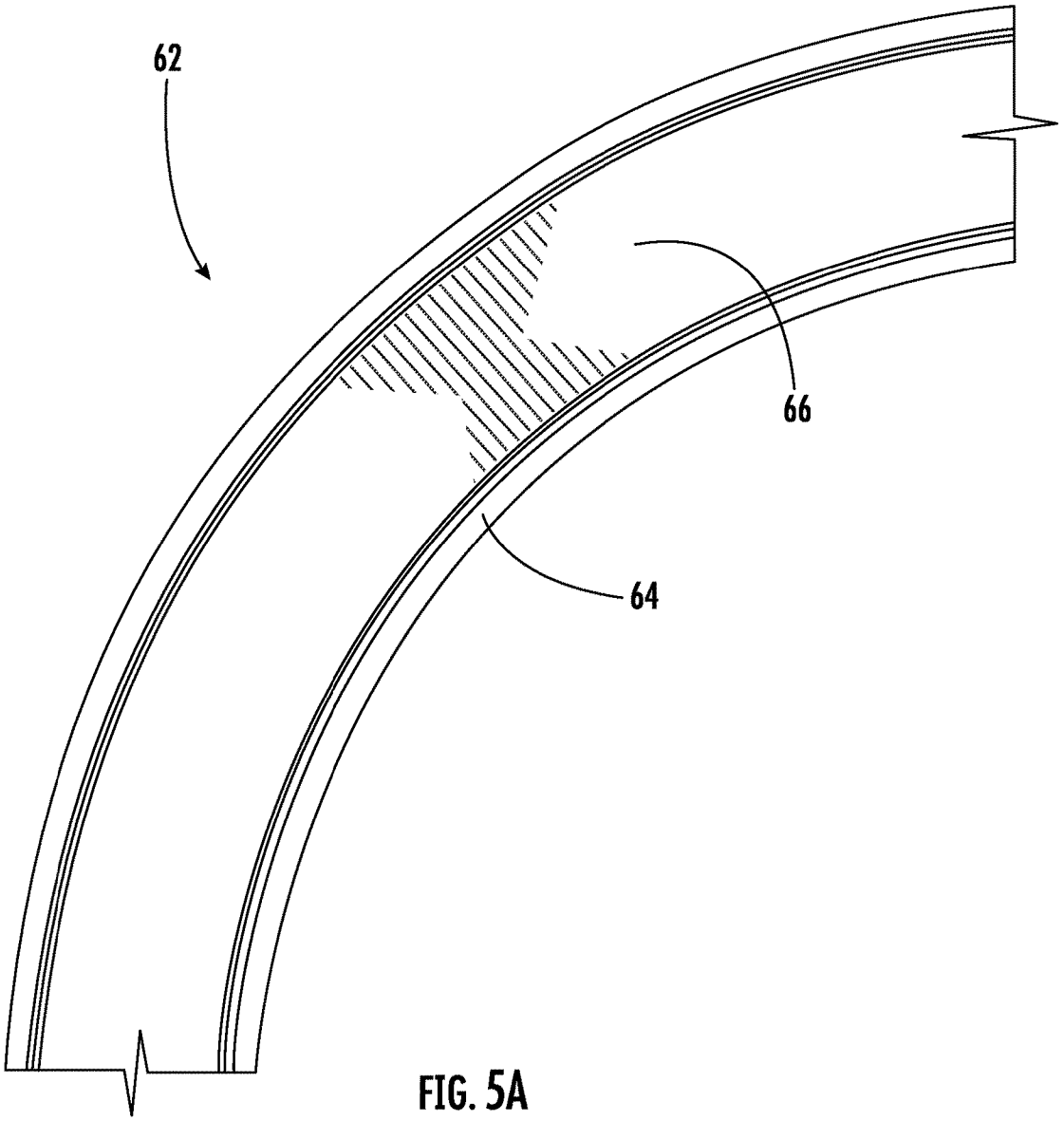
FIG. 5A is a top view of a portion of a silencer housing according to an embodiment.

Located within the diffuser section 30 of the compressor 10, opposite the first surface 48 of the diffuser structure 40 is a silencer 60. The silencer 60 may be mounted to a surface of the compressor housing facing the diffuser section 30, or alternatively, may be positioned within a circumferential groove (not shown) formed in the compressor housing. Referring now to FIGS. 4-7, an example of a silencer 60 configured for use with a centrifugal compressor 10 is illustrated in more detail. As best shown in FIGS. 5A and 5B, the silencer 60 includes a housing 62 formed from an annular structure 64 and including an annular hollow cavity 66 formed in the annular structure 64. In an embodiment, the inner diameter of the silencer 60 may be generally equal to the inner diameter of the diffuser structure 40, and an outer diameter of the silencer 60 may be generally equal to or slightly greater than the outer diameter of the diffuser structure 40. The housing 62 may be formed from any suitable material, such as a sheet metal for example. A first, exterior surface 68 of the housing 62 is configured as a mounting surface. The mounting surface 68 provides a mounting interface and should abut against a portion of the compressor 10, such as the circumferential groove for example, when the silencer 60 is arranged at an installed position.

Figure 6:
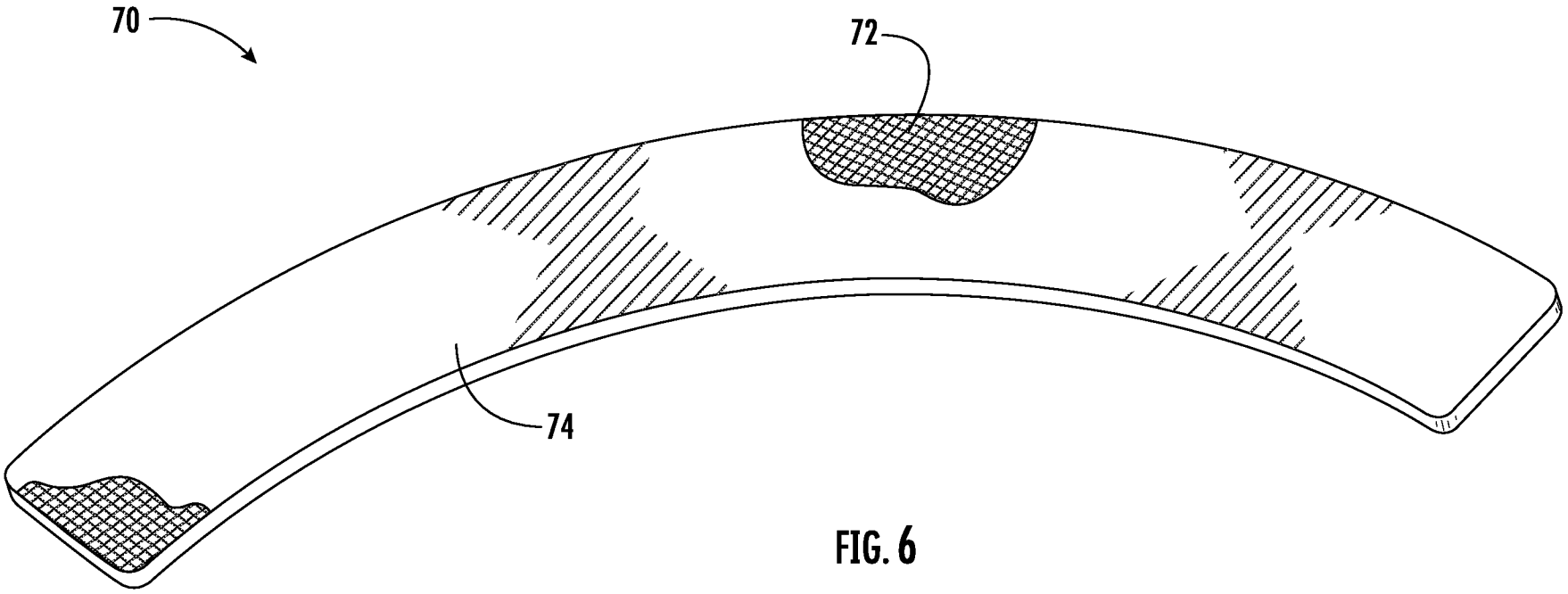
FIG. 6 is a perspective view of a silencer pad according to an embodiment.

A silencing pad 70 is disposed within the cavity 66 of the housing 62. The silencing pad 70 absorbs sound and reduces noise of the silencer 60. The body 72 of the silencing pad 70 may be formed from any suitable material including a metal, plastic, composite, or sound absorbing material. Examples of suitable sound absorbing materials, include but are not limited to glass fiber (e.g., compressed batting), polymeric material such as fiber, foam, or expanded bead material (e.g., porous expanded polypropylene (PEPP)), and combinations thereof for example. In an embodiment, in order to improve the noise reduction effect, the silencing pad 70 may include a plurality of layers of sound absorbing material, thereby providing a better sound absorbing effect. Alternatively, or in addition, the body 72 may be encased within a jacket 74, such as formed from a glass, polymer, or metallic mesh or fabric for example, as shown in FIG. 6. The silencing pad 70 may be retained within the cavity 66 of the housing 62 in a variety of ways, such as via an adhesive or one or more fasteners for example. When installed, the exposed surface 76 of the silencing pad 70 facing the diffuser structure 40 is substantially aligned with the upper surface 69 of the adjacent silencer housing 62.

In embodiments where the silencer 60 is relative large, and thus the hollow annular cavity 66 defined by the housing 62 is relatively large, a large volume of silencing pad 70 is required to fill the cavity 66. To avoid a reduction in the structural integrity of the silencer 60, one or more reinforcing portions may be located within the cavity 66 to provide added bearing strength. For example, as shown in FIG. 7, one or more reinforcing ribs 78 may be disposed about the circumference of the cavity of the housing 62 to improve the structural strength of the silencer 60.

Figure 7:
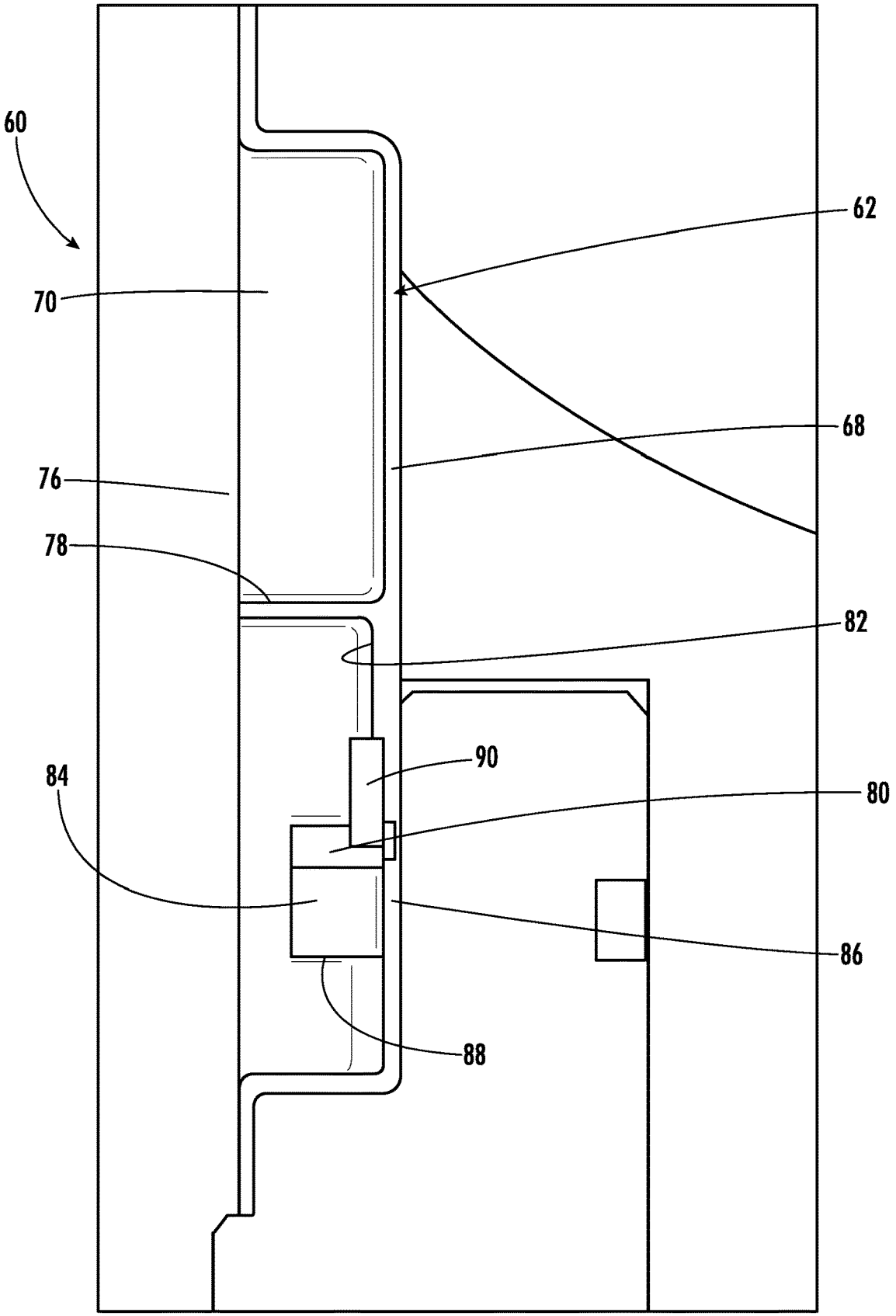
FIG. 7 is a cross-sectional view of a silencer according to an embodiment.

With continued reference to FIG. 7, the silencer 60 may additionally include one or more mounting portions 80 for positioning and fastening the silencer 60 within the compressor 10. In an embodiment, the mounting portion 80 extends into the cavity 66 from a surface 82 of the housing 62. The mounting portion 80 has a central opening 84 substantially aligned with an opening 86 formed in the mounting surface 68 of the silencer housing 62. In an embodiment, the central opening 84 of the mounting portion 80 is threaded and is configured to function as a nut when coupled with a fastener (not shown). The silencer pad 70 located within the cavity 66 may include a corresponding mounting groove 88 to provide space for the mounting portion 80 within the cavity 66. In some embodiments, a washer 90 may be arranged concentrically with part of the mounting portion 80 at a position between the interior surface 82 of the housing 62 and the silencer pad 70.

One or more fasteners, such as bolts or screws for example, may be used to couple the silencer pad 70 and the mounting portion to the compressor housing 12 to affix the silencer 60 to the compressor housing 12. In an embodiment, the fastener is countersunk into the surface 76 of the silencer pad 70. By using a countersunk fastener, the exposed circulation surface 76 of the silencer pad 70 remains smooth, and does not include one or more protrusions extending therefrom. This smooth surface provides enhance noise reduction effects. In addition, a smooth surface 76 may be required for operation, such as in embodiments where the diffuser structure 40 is rotatable.

When the diffuser structure 40 and the silencer 60 are installed, the diffuser structure 40 and the silencer 60 are substantially aligned. Further, an end surface of each of the plurality of vanes 46 of the diffuser structure 40 is arranged in contact with the surface 76 of the body of the silencing pad 70. In the illustrated, non-limiting embodiment, both the surface of the vanes 46 and the surface of the silencing pad 70 are generally planar. However, embodiments where the surfaces of the vanes 46 and the silencing pad 40 have a non-planar but generally complementary configuration are also contemplated herein. Through this contact, the vanes are sealed against the silencer 60. The position of the diffuser structure 40 may be adjustable relative to the silencer 60 to ensure that a desired contact is achieved between the diffuser structure 40 and the silencer 60. However, in other embodiments, the position of the silencer 60 may also be adjusted. In an embodiment, the diffuser structure 40 and the silencer 60 may be configured and/or positioned such that the plurality of vanes 46 applies a compressive force to the surface 76 of the silencer pad 70. In an embodiment, compression of up to 10% of the thickness of the silencer pad is contemplated herein; however compression of 0.001 or 0.002 inches is suitable for operation of the compressor 10.

The term "about" is intended to include the degree of error associated with measurement of the particular quantity based upon the equipment available at the time of filing the application.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

While the present disclosure has been described with reference to an exemplary embodiment or embodiments, it will be understood by those skilled in the art that various changes may be made and equivalents may be substituted for elements thereof without departing from the scope of the present disclosure. In addition, many modifications may be made to adapt a particular situation or material to the teachings of the present disclosure without departing from the essential scope thereof. Therefore, it is intended that the present disclosure not be limited to the particular embodiment disclosed as the best mode contemplated for carrying out this present disclosure, but that the present disclosure will include all embodiments falling within the scope of the claims.

What is claimed is:

1. A compressor comprising: a diffuser section comprising: a diffuser structure; and a silencer including: a silencer housing defining a cavity, the silencer housing having a mounting portion extending into an interior of the cavity; and a silencing pad disposed within the cavity, the silencing pad having a mounting groove for receiving the mounting portion therein, wherein an exposed surface of the silencing pad is arranged in contact with a portion of the diffuser structure.

2. The compressor of claim 1, wherein the diffuser structure include a plurality of vanes, the plurality of vanes being arranged in contact with the exposed surface of the silencing pad.

3. The compressor of claim 1, wherein the diffuser structure is fixed.

4. The compressor of claim 1, wherein the diffuser structure is rotatable about an axis.

5. The compressor of claim 1, wherein the diffuser structure is mounted to a first surface of the compressor.

6. The compressor of claim 1, wherein the diffuser structure is integrally formed with a first surface of the compressor.

7. The compressor of claim 1, wherein the silencer is affixed to a surface of the compressor facing the diffuser section.

8. The compressor of claim 1, wherein the silencer is arranged within a circumferential groove formed in a surface of the compressor facing the diffuser section.

9. The compressor of claim 1, wherein the exposed surface of the silencing pad is partially compressed by the contact with the portion of the diffuser structure.

10. The compressor of claim 1, wherein the silencing pad is formed from a flexible material.

11. The compressor of claim 10, wherein the silencing pad includes a sound absorbing material.

12. The compressor of claim 11, wherein the silencing pad includes a plurality of sound absorbing material layers.

13. The compressor of claim 10, wherein the silencing pad further comprises:

a body formed from a sound absorbing material; and a jacket encasing the body.

14. The compressor of claim 13, wherein the jacket includes at least one of glass, polymer, and metallic mesh or fabric.

15. The compressor of claim 1, wherein the compressor is a centrifugal compressor.

16. The compressor of claim 15, wherein the diffuser section is arranged at a first stage of the compressor.

17. The compressor of claim 15, wherein the diffuser section is arranged at a second stage of the compressor.

* * * * *